US005839379A

United States Patent [19]

Freermann

[11] Patent Number: 5,839,379

[45] Date of Patent: Nov. 24, 1998

[54] APPARATUS FOR MAKING A PILLOW OR BLANKET CASE

[75] Inventor: Johannes Freermann, Ochtrup, Germany

[73] Assignee: Carl Schmale GmbH & Co., Ochtrup, Germany

[21] Appl. No.: 850,215

[22] Filed: May 1, 1997

[30] Foreign Application Priority Data

May 2, 1996 [DE] Germany ..... 196 17 438.4

[51] Int. Cl.[6] ..... D05B 13/00; D05B 21/00

[52] U.S. Cl. ..... 112/10; 112/470.06; 112/470.16

[58] Field of Search ..... 112/470.16, 470.06, 112/470.07, 470.33, 475.06, 475.07, 475.04, 304, 311, 147, 63, 10

[56] References Cited

U.S. PATENT DOCUMENTS 4,754,717 7/1988 Henze et al. ..... 112/10
5,363,784 11/1994 Adamski, Jr. et al. ..... 112/470.16 X
5,379,708 1/1995 Moll et al. ..... 112/63 X

*Primary Examiner*—Peter Nerbun
*Attorney, Agent, or Firm*—Herbert Dubno; Andrew Wilford

[57] ABSTRACT

An apparatus for making a pillow or blanket case from a textile strip has a vertically movable gripper engageable with one of the end edges of the strip, a support surface generally below the movable gripper, a conveyor defining a horizontal transport direction opening at an upstream end generally at the support surface, and a vertically and horizontally movable plate above the support surface. Respective actuators connected to the gripper and plate are operated by a controller also connected to conveyor for, after securing the one end edge in the gripper with the other end edge secured underneath the plate and with the strip extending from the movable gripper between the plate and the support surface, first pressing the plate downward against the support surface and thereby pressing the other end edge down against a central region of the strip. Then the plate is pushed into the upstream end of the conveyor to form a fold in the central region and press this fold into the conveyor. Thereafter the folded strip is drawn into the conveyor while synchronously lowering the gripper. The longitudinal edges of the strip are stitched together downstream of the conveyor.

18 Claims, 6 Drawing Sheets

FIG. 2
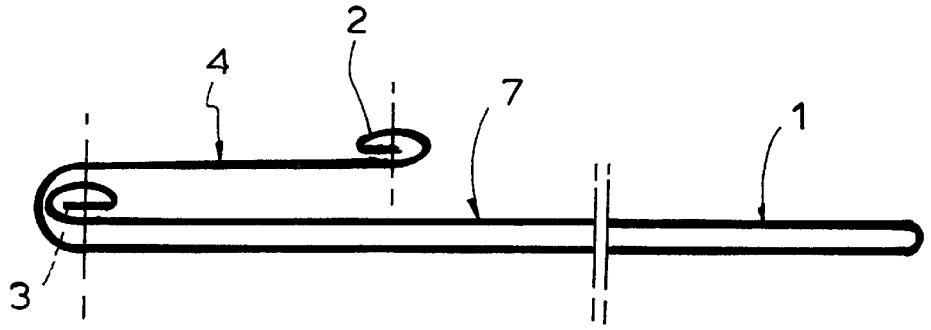
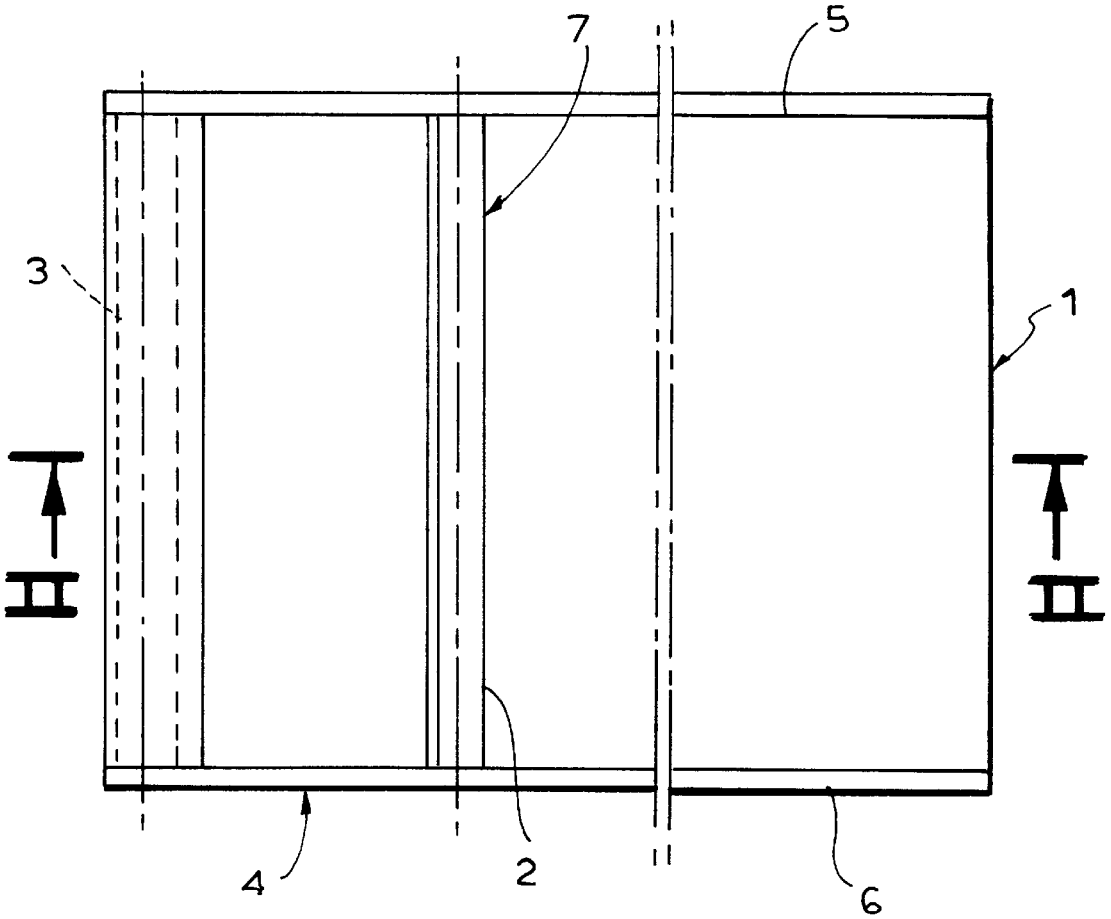
FIG. 1

APPARATUS FOR MAKING A PILLOW OR BLANKET CASE

FIELD OF THE INVENTION

The present invention relates to the manufacture of a pillow or blanket case. More particularly this invention concerns an apparatus for making such a case.

BACKGROUND OF THE INVENTION

A standard pillow or blanket case is made of a rectangular and elongated strip of fabric. Normally the two short ends of the strip are folded over and seamed or selvedged, then the strip is folded crosswise to form a long rear panel and a short front panel joined at a lower fold and with the long rear panel projecting past the upper seamed edge of the front panel. The upper end portion of the rear panel that extends past the upper edge of the front panel is then folded down over the front panel and the assembly thus produced is stitched up along both longitudinal edges and then turned inside out. The result is a rectangular case the size of the front panel and having at a slight spacing inward of one of its ends a slot through which a pillow, blanket, or the like can be introduced into the case.

Such a mass-production item is typically produced by cutting the strip off a continuous web and hemming the two end edges. Then the strip is folded into the necessary shape and first its one longitudinal edge and then its other longitudinal edge are stitched together. The workpiece is inverted and the case is complete.

While special-duty layout tables and sewing machines are used to make such a case, the procedure is still mainly a manual one. Not only does such manual production entail considerable cost, but it is also slow. Obviously this results in elevated manufacturing costs of the finished item.

OBJECTS OF THE INVENTION

It is therefore an object of the present invention to provide an improved apparatus for making a pillow or blanket case.

Another object is the provision of such an improved apparatus for making a pillow or blanket case which overcomes the above-given disadvantages, that is which allows the case to be produced easily and at high speed.

SUMMARY OF THE INVENTION

A textile strip having a pair of parallel longitudinal side edges and a pair of parallel transverse end edges bridging the side edges is formed by an apparatus into a rectangular pillow or blanket case having a front panel, a rear panel joined at a fold to a lower end of the front panel and lying against a rear face of the front panel, and a foldover panel joined at a fold to an upper end of the rear panel, lying against a front face of the front panel, and forming a slot opening into the casing. The apparatus has according to the invention a vertically movable gripper engageable with one of the end edges of the strip, a support surface generally below the movable gripper, a conveyor defining a horizontal transport direction opening at an upstream end generally at the support surface, and a vertically and horizontally movable plate above the support surface. Respective actuators connected to the gripper and plate are operated by a controller also connected to conveyor for, after securing the one end edge in the gripper with the other end edge secured underneath the plate and with the strip extending from the movable gripper between the plate and the support surface, first pressing the plate downward against the support surface and thereby pressing the other end edge down against a central region of the strip. Then the plate is pushed into the upstream end of the conveyor to form a fold in the central region and press this fold into the conveyor. Thereafter the folded strip is drawn into the conveyor while synchronously lowering the gripper. The longitudinal edges of the strip are stitched together downstream of the conveyor.

This apparatus therefore automates a fairly complex operation. For a small workpiece, for instance to make a pillow case or the like, a single operator need merely load the strip into the machine by appropriately positioning its end edges, and the machine will take over and produce a perfect finished product. For a blanket cover normally two workers load the apparatus.

According to the invention a fixed gripper is for the other end edge of the strip downstream of the support surface so that the other end edge can be held in the fixed gripper while the one end edge is are fitted to the movable gripper. Thus the other end edge is parked here while the one end edge is being threaded through the apparatus and fitted to the movable gripper. The fixed gripper is spring loaded.

To accommodate workpieces of different widths the gripper and conveyor include respective pairs of gripper and conveyor subassemblies that are transversely displaceable relative to each other. These subassemblies, which are identical and work synchronously, are moved together for narrow workpieces and apart for wide ones.

The conveyor according to the invention includes a pair of transport belts and the support surface is formed by an L-shaped horizontal plate having an upstream end formed by a downwardly directed flap. A rotatable deflecting roller having a nonslip surface is provided immediately upstream of the support surface.

The movable gripper in accordance with the invention has a pair of jaws and a stop against which the one edge can be positioned for accurate gripping of the one edge by the jaws. This movable gripper includes a stationary vertical guide along which it is displaceable. A weight can be provided for counterbalancing the weight of the movable gripper.

The controller according to the invention further serves for opening the gripper on drawing of the folded strip into the conveyor when the gripper is close to the support surface. To this end the controller has a switch operable for opening and closing the gripper. The gripper is displaceable through a vertical stroke between a lower position close to the support surface and an upper position remote therefrom. The controller automatically displaces the gripper into the upper position on actuation of the switch.

The strip hangs in a loop between its end edges when the one end edge is secured in the gripper and the other end edge is secured to the plate. The apparatus further has according to the invention a unit for tensioning the strip in the loop. This unit includes at least one rod insertable into the loop and means for moving the rod downward away from the support surface. More particularly, the rod is formed by two coaxial rods horizontally displaceable transversely of the strip between an inner position inserted into the strip and an outer position clear of the strip. In addition means is provided for spreading and dewrinkling the strip in the loop. This spreader includes a pair of spreader elements engageable with the strip in the loop and movable outwardly away from each other to spread the strip.

BRIEF DESCRIPTION OF THE DRAWING

The above and other objects, features, and advantages will become more readily apparent from the following description, reference being made to the accompanying drawing in which:

FIGS. 1 and 2 are edge and top views of a partially manufactured blanket or pillow case according to the invention;

SPECIFIC DESCRIPTION

Figure 3:
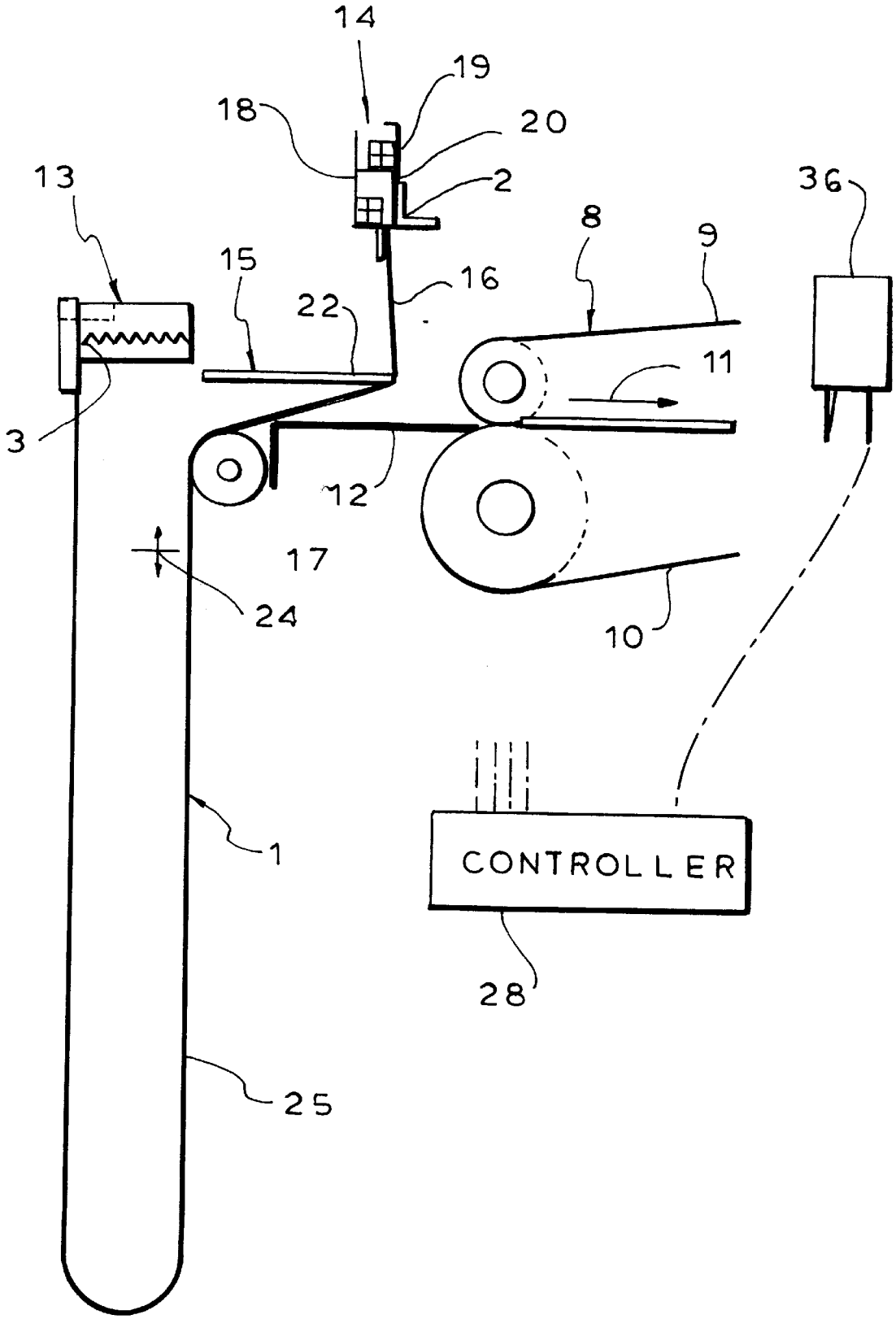
FIGS. 3, 4, and 5 are largely diagrammatic small-scale side views showing the operation of the system according to the invention.
Figure 4:
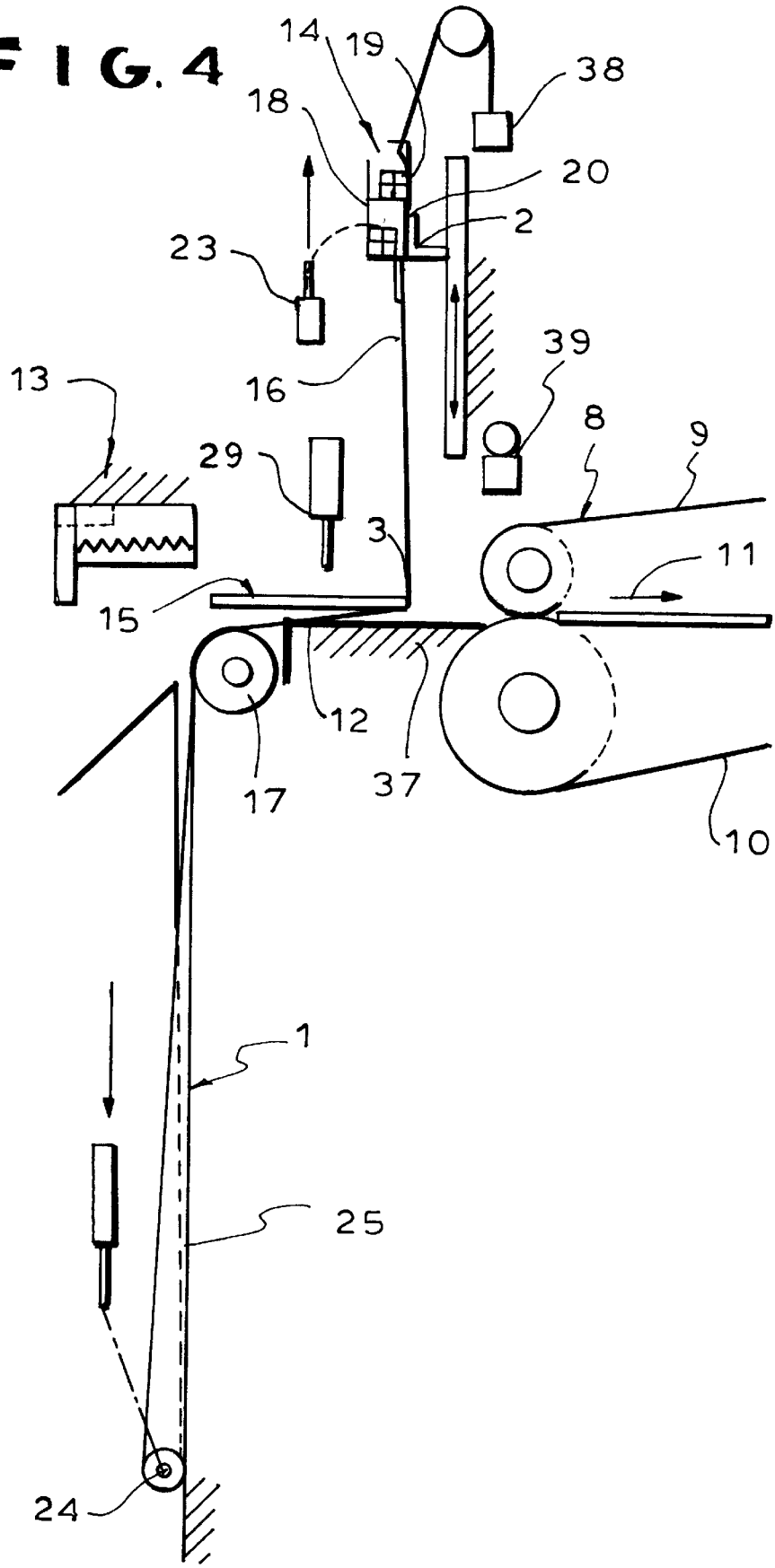

As seen in FIGS. 1 and 2, a pillow case according to the invention is made of a basically rectangular strip 1 of woven textile having two seamed end edges 2 and 3. As is standard the case is formed by folding over an end portion of the strip 1 and then stitching together the two longitudinal edges 5 and 6 of the folded strip. This forms a region 4 of triple thickness and leaves a slot opening 7 that allows the assembly to be turned inside out and used.

The apparatus for making such a case comprises two identical subassemblies that are spaced apart and that act synchronously on the respective longitudinal edges 5 and 6 of the workpiece. A spindle arrangement or the like allows the crosswise spacing between the two subassemblies to be varied depending on the width of the goods. As shown in FIGS. 3 through 7 each such subassembly has a conveyor 8 having a pair of conveyor belts 9 and 10 defining a horizontal transport direction 11. Immediately upstream of the nip formed between the two belts 9 and 10 is a support plate 12 fixed on a housing or frame 37 of the machine. A downwardly open cutout 22 on the plate 15 serves as a stop for positioning the seamed end edge 3 as will be described below.

A stationary spring-loaded clamp or gripper 13 for the edge 3 is provided adjacent this plate 12 and above it is a pneumatically operated gripper or clamp 14 for the edge 2 which can be vertically displaced by an actuator 23. A horizontal guide plate 15 can be moved vertically and horizontally above the plate 12 by an actuator 29 connected to a controller 28.

Immediately upstream of a bent-down upstream end of the support plate 12 is a crosswise roller 17 with a nonslip coating that is used to tension and stretch out the strip 1. In addition a stretcher 24 has a pair of coaxial crosswise stretcher rods 26 (one only shown in FIGS. 6 and 7) that can be inserted into a pendant loop 25 of the workpiece 1 and can be displaced vertically by an actuator 27 to tension the strip 1. When moved into their upper end position, an unillustrated actuator displaces the rods 26 outward out of the loop 25.

The clamp 18 is, like the clamp 13, downwardly open, but has a pneumatically controlled movable jaw 14 pivoted at 19 and a fixed jaw 20. The actuator 23 can also spread and close these jaws 18 and 20. An abutment bar 21 fixed on the jaw 20 serves as a stop for positioning the seam 2 at the leading edge of the strip 1. A counterweight 38 can completely cancel out the weight of the gripper 14 or can be dimensioned so it returns smoothly to the upper or lower end position when the gripper 14 is released.

Figure 6:
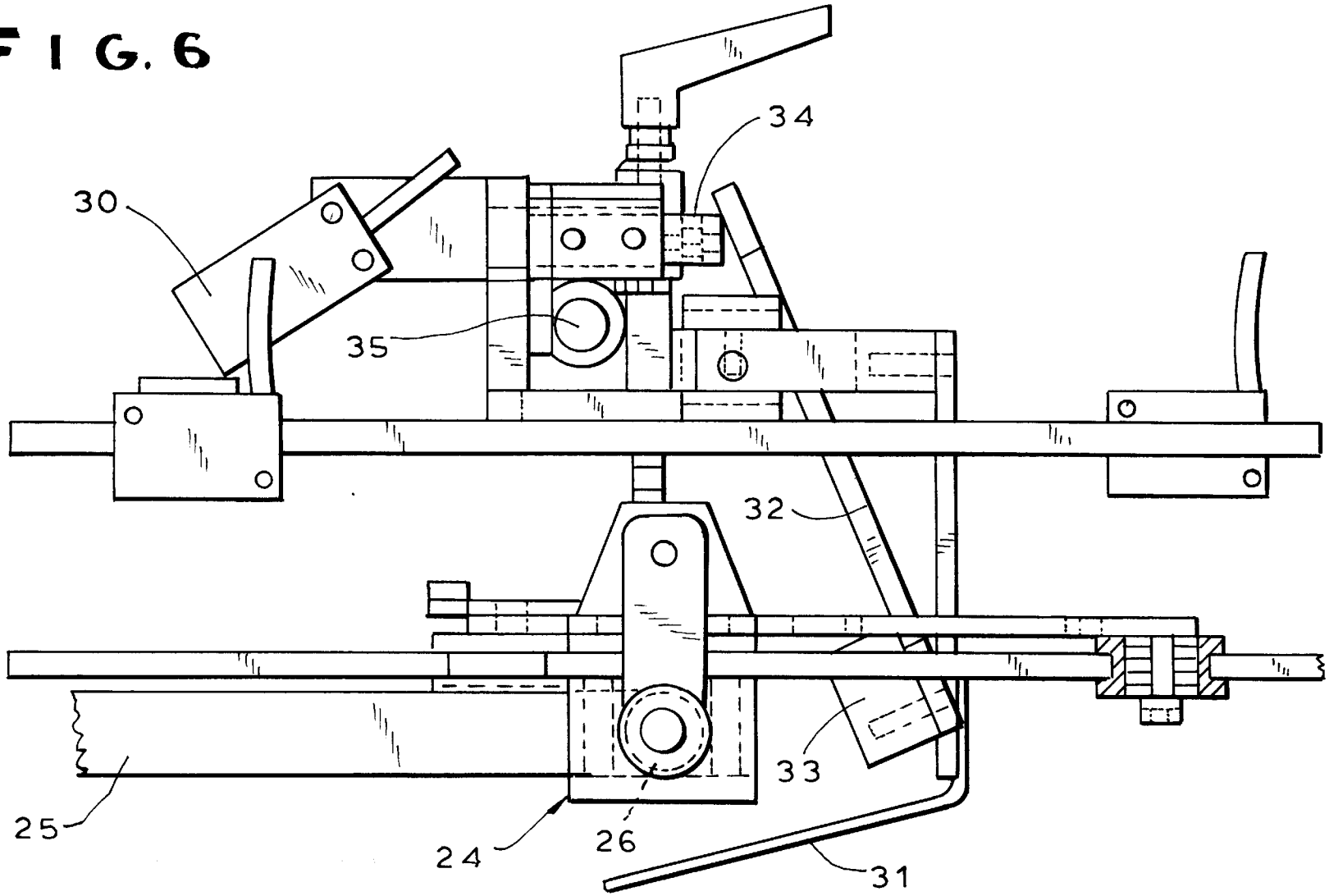
FIGS. 6 and 7 are side and top views of a detail of the apparatus.
Figure 7:
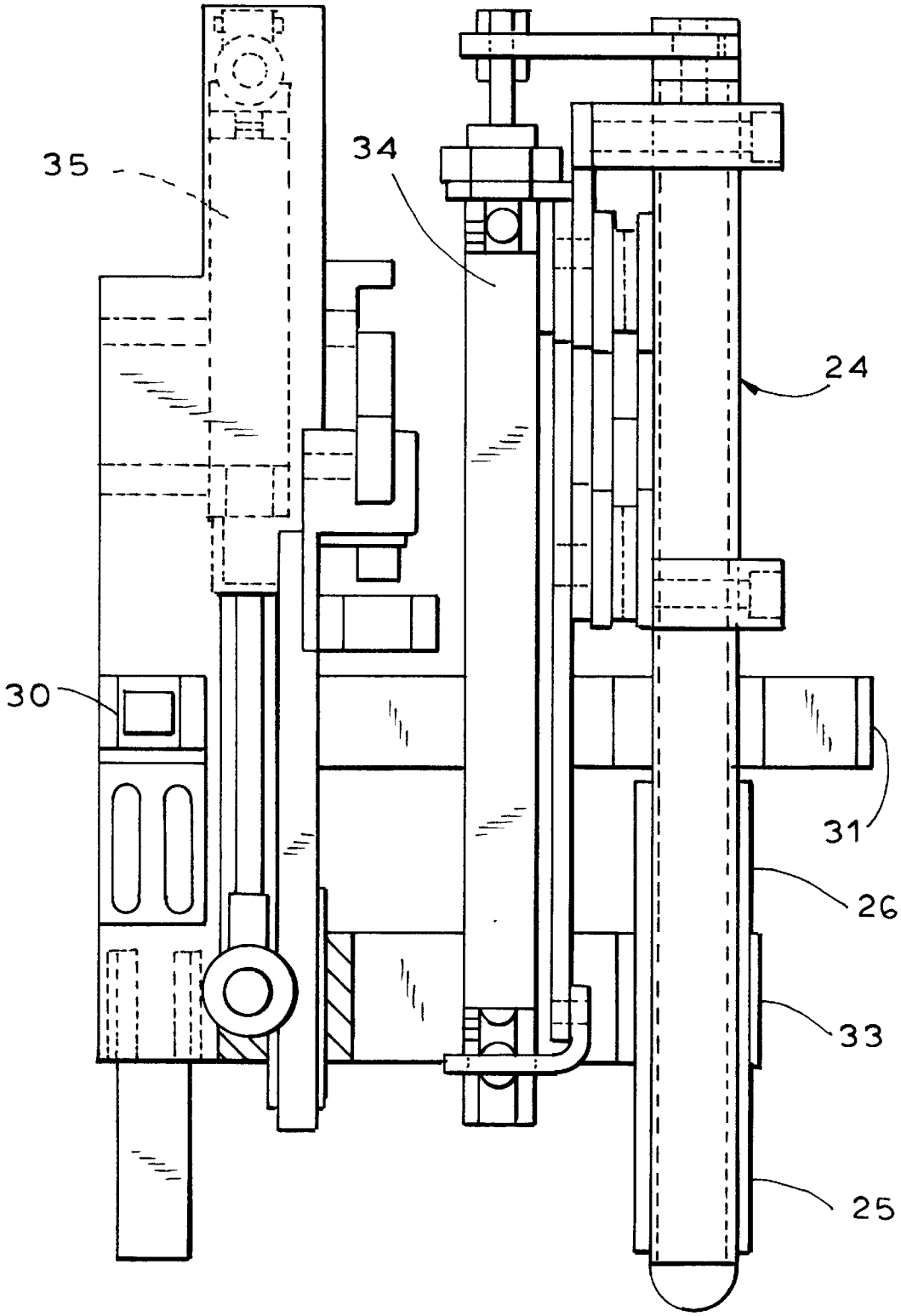

FIGS. 6 and 7 show a spreader that works with the bars 26 of the stretcher 24. This system has at each longitudinal edge of the goods a photocell unit 30 cooperating with a mirror 31 to detect the transverse position of the respective edge 5 or 6. An edge aligner 32 carries a friction element 33. pneumatic cylinder 34 can press the element 33 against the respective rod 26 and another such actuator 35 can displace it outward while rubbing on this rod 26. Thus if one of the photocell units 30 determines that the respective edge 5 or 6 is not in the desired transverse position, meaning that the strip is bunched toward the middle, the actuator 34 and then the actuator 35 are actuated to spread the goods transversely.

This device is operated as follows:

After hemming the end edges 2 and 3, the edge 3 is engaged in the gripper 13. If the goods are narrow one person can do this, clipping each end in the appropriately spaced gripper subassemblies and if the goods are wide this will be a two-person job.

The other edge 2 is then guided up over the roller 17 and through the gap between the lower face of the plate 15 and the upper face of the plate 12, and this edge 2 is similarly fitted to the gripper 14, normally while an operator actuates a switch 39 to hold it open. The edge 2 is butted against the stop 21 and the switch 39 connected to the controller 28 is actuated so that the gripper 14 is closed to ensure perfect positioning of the edge 2 and to raise the gripper 14. At this time the rods 26 are inserted from the ends into the loop 25.

The operator or operators then take the other edge 3 of the strip 1 and pull it down out of the spring-loaded clip 13 and fit it to the cutout guide 22 of the plate 15. The rods 26 are then pushed downward by the actuators 27 under the control of the controller 28. If necessary the edge-aligning system shown in FIGS. 6 and 7 is operated to spread the goods. The system is left in the position of FIG. 4.

Figure 5:
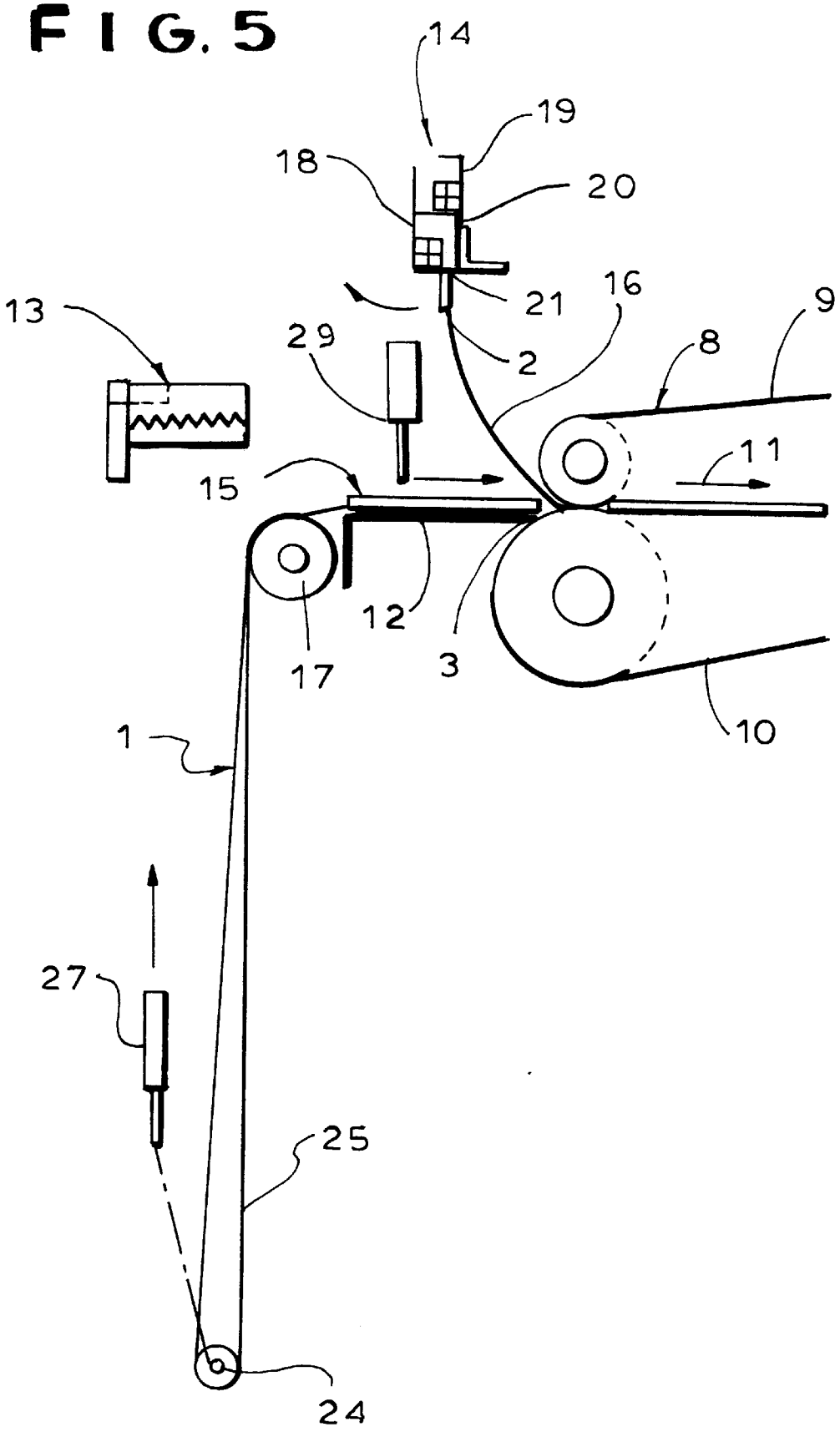

Then as shown in FIG. 5 the actuator 29 presses the plate 15 down on the plate 12 to compress two layers of the strip 1 together and then this actuator 29 pushes the plate 15 into the nip between the belts 9 and 10 in the direction 11. This forms a fold in the strip 1 at the desired location. As the strip 1 is then drawn into the conveyor 8 the plate 15 is retracted and the gripper 14 is either lowered and opened, or simply opened to release the edge 2 and allow the end section 16 to be pulled into the conveyor 8. Sewing machines 36 (only one shown in FIG. 3) also operated by the controller 28 seam the two edges 5 and 6 as the strip 1 is pulled through the machine. The rollers 26 keep the strip 1 under tension until perfect feed is certain. Then appropriate actuators pull them laterally out of the loop 25.

I claim:

1. An apparatus for making a case by forming a textile strip having a pair of parallel longitudinal side edges and a pair of parallel transverse end edges bridging the side edges into a rectangular pillow or blanket case having a front panel, a rear panel joined at a fold to a lower end of the front panel and lying against a rear face of the front panel, and a foldover panel joined at a fold to an upper end of the rear panel, lying against a front face of the front panel, and forming a slot opening into the case, the apparatus comprising:

a vertically movable gripper engageable with one of the end edges of the strip;

a support surface generally below the movable gripper;

a conveyor extending in a horizontal transport direction and opening at an upstream end generally at the support surface;

a vertically and horizontally movable plate above the support surface;

respective actuators connected to the gripper and plate;

control means connected to the actuators and conveyor for, after securing the one end edge in the gripper with the other end edge secured underneath the plate and with the strip extending from the movable gripper between the plate and the support surface, pressing the plate downward against the support surface and thereby pressing the other end edge down against a central region of the strip, thereafter pushing the plate into the upstream end of the conveyor and thereby forming a fold in the central region and pressing this fold into the conveyor, and thereafter drawing the folded strip into the conveyor while synchronously lowering the gripper; and a pair of stitching heads flanking the conveyor for stitching together the longitudinal edges of the strip downstream of the conveyor.

2. The case-making apparatus defined in claim 1, further comprising a fixed gripper for the other end edge of the strip downstream of the support surface, whereby the other end edge can be held in the fixed gripper while the one end edge is being fitted to the movable gripper.

3. The case-making apparatus defined in claim 2, wherein the fixed gripper is spring loaded.

4. The case-making apparatus defined in claim 1, wherein the gripper and conveyor include respective pairs of gripper and conveyor subassemblies that are transversely displaceable relative to each other.

5. The case-making apparatus defined in claim 1, wherein the conveyor includes a pair of transport belts.

6. The case-making apparatus defined in claim 1, wherein the support surface is formed by an L-shaped horizontal plate having an upstream end formed by a downwardly directed flap.

7. The case-making apparatus defined in claim 6, further comprising a rotatable deflecting roller having a nonslip surface immediately upstream of the support surface.

8. The case-making apparatus defined in claim 1, wherein the movable gripper has a pair of jaws and a stop against which the one edge can be positioned for accurate gripping of the one edge by the jaws.

9. The case-making apparatus defined in claim 8, wherein the movable gripper includes a stationary vertical guide along which the gripper is displaceable.

10. The case-making apparatus defined in claim 9, wherein the movable gripper includes a counterweight counterbalancing the weight of the movable gripper.

11. The case-making apparatus defined in claim 1, wherein the control means further serves for opening the gripper on drawing of the folded strip into the conveyor when the gripper is close to the support surface.

12. The case-making apparatus defined in claim 1, wherein the control means includes a switch operable for opening and closing the gripper.

13. The case-making apparatus defined in claim 12, wherein the gripper is displaceable through a vertical stroke between a lower position close to the support surface and an upper position remote therefrom, the control means automatically displacing the gripper into the upper position on actuation of the switch.

14. The case-making apparatus defined in claim 1, wherein the strip hangs in a loop between its end edges when the one end edge is secured in the gripper and the other end edge is secured to the plate, the apparatus further comprising means for tensioning the strip in the loop.

15. The case-making apparatus defined in claim 14, wherein the tensioning means includes at least one rod insertable into the loop and means for moving the rod downward away from the support surface.

16. The case-making apparatus defined in claim 15, wherein the rod is formed by two coaxial rods horizontally displaceable transversely of the strip between an inner position inserted into the strip and an outer position clear of the strip.

17. The case-making apparatus defined in claim 15, further comprising means for spreading and dewrinkling the strip in the loop.

18. The case-making apparatus defined in claim 17, wherein the spreading means includes a pair of spreader elements engageable with the strip in the loop and movable outwardly away from each other to spread the strip.

* * * * *